US005600415A

United States Patent [19]

Takahashi

[11] Patent Number: 5,600,415

[45] Date of Patent: Feb. 4, 1997

[54] IMAGE FORMING APPARATUS WITH DEVELOPING BIAS CONTROL

[75] Inventor: Kazuhiko Takahashi, Iwatsuki, Japan

[73] Assignee: Fuji Xerox Co., Ltd., Tokyo, Japan

[21] Appl. No.: 295,033

[22] Filed: Aug. 25, 1994

[30] Foreign Application Priority Data

Aug. 27, 1993 [JP] Japan ..... 5-212615

[51] Int. Cl.[6] ..... G03G 15/00

[52] U.S. Cl. ..... 399/55

[58] Field of Search ..... 355/270, 245, 355/246, 203–209, 251, 253, 211; 118/652, 656, 657; 430/125

[56] References Cited

U.S. PATENT DOCUMENTS

| | | | |
|---|---|---|---|
| 4,350,750 | 9/1982 | Suzuki et al. | 430/125 |
| 4,465,360 | 8/1984 | Yamagishi et al. | 355/270 |
| 4,480,905 | 11/1984 | Yoshino | 118/651 |
| 4,547,064 | 10/1985 | Ammenheuser et al. | 355/245 |
| 4,754,304 | 6/1988 | Ohashi et al. | 430/125 |
| 5,229,825 | 7/1993 | Yousey et al. | 355/270 |

*Primary Examiner*—Thu A. Dang
*Attorney, Agent, or Firm*—Oliff & Berridge

[57] ABSTRACT

An image forming apparatus capable of preventing a toner from being left on a photosensitive member upon turning off a developing bias for jumping development. A phase detecting circuit generates a phase detection signal which becomes H level when the developing bias is positive, whereas becoming L level when the developing bias is negative. A phase controller generates a phase-controlled developing bias off signal to an output controller at a timing when the phase detection signal changes from H level to L level for the first time after the phase controller receives a developing bias off signal from a CPU. Then, the output controller stops oscillation of an oscillating circuit, thereby turning off the developing bias at a timing when the toner has returned from the photosensitive member to a developing unit. Accordingly, the toner is prevented from being left on the photosensitive member upon turning off the developing bias.

13 Claims, 8 Drawing Sheets

POTENTIAL
TIME
31
32
0V
33
34

"H"
"L"

"H"
"H"
"L"
"L"

"H"
"L"

"H"
"H"
"L"

t3
t2
t1

TA
TB
"H"
"H"
"L"

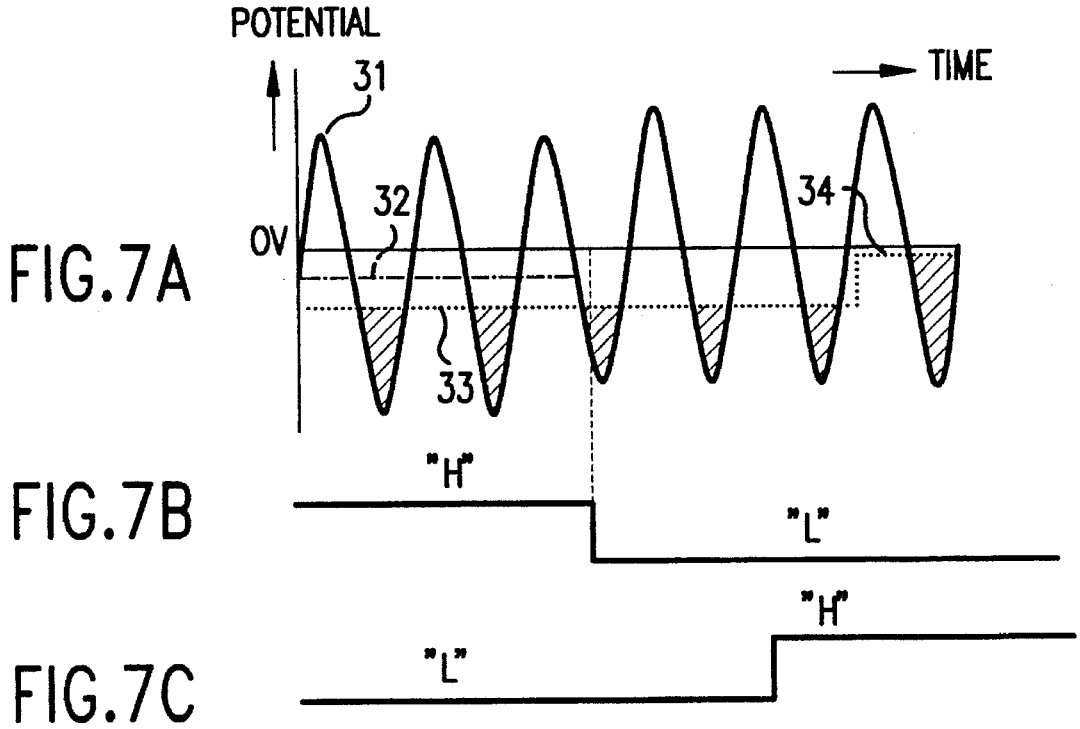
FIG.7A
FIG.7B
FIG.7C
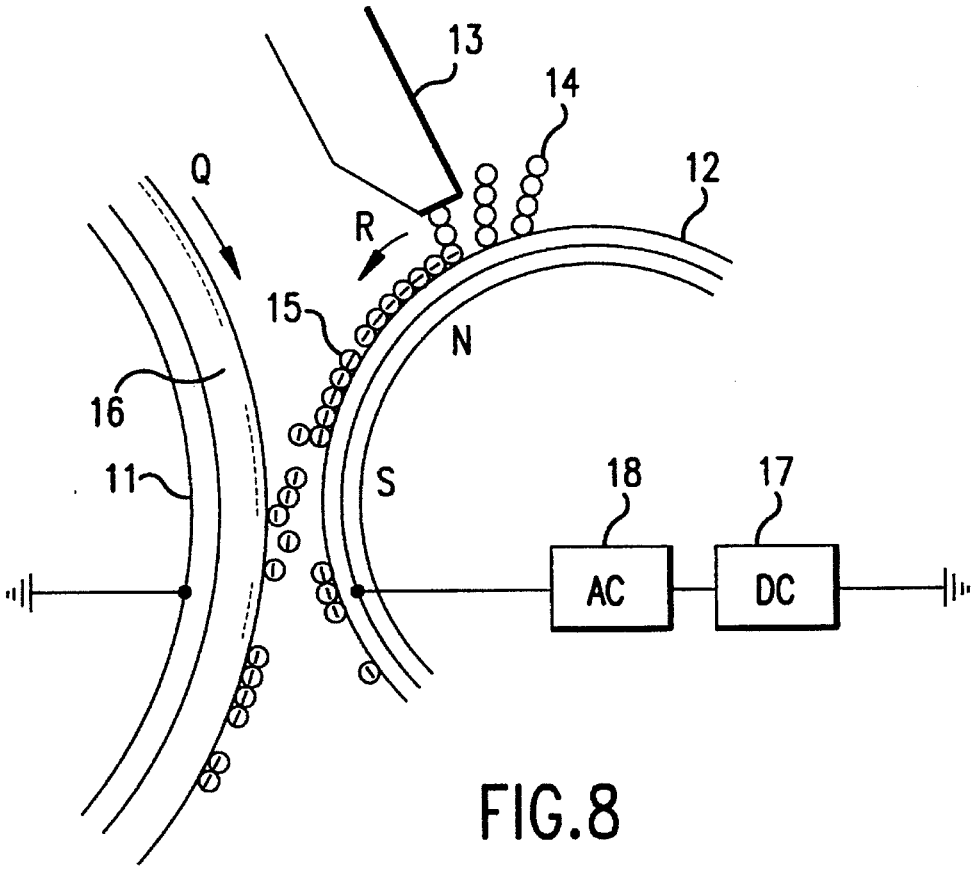
FIG.8

IMAGE FORMING APPARATUS WITH DEVELOPING BIAS CONTROL

BACKGROUND OF THE INVENTION

1. Field of the Invention

The present invention relates to an image forming apparatus, such as a laser beam printer and a copying machine, for forming an image on a recording medium, and more particularly to an image forming apparatus using a jumping development process to develop an electrostatic latent image formed on a photosensitive member.

2. Description of the Related Art

An image forming apparatus such as a laser beam printer and a copying machine is usually provided with a photosensitive member and an exposure unit such as a laser scanner for exposing the photosensitive member to light. In the vicinity of the surface of the photosensitive member there are provided a developing unit for developing an electrostatic latent image formed on the photosensitive member and a transferring unit for transferring a toner image obtained by development of the electrostatic latent image onto a recording paper. Further, a fixing unit for fixing the toner image transferred onto the recording paper is provided near a paper outlet from which the recording paper after printed is ejected.

A development system for developing the electrostatic latent image formed on the photosensitive member in such an image forming apparatus is generally classified into a one-component development system and a two-component development system. The one-component development system is simple in mechanism; so, it is applied especially to a compact laser beam printer.

FIG. 8 shows the principle of operation of a jumping development process as one process in the category of the one-component development system. As shown in FIG. 8, a photosensitive drum 11 and a conductive sleeve 12 are arranged in such a manner that their axes of rotation are parallel to each other and their cylindrical surfaces are spaced from each other. A toner 14 is supplied from a toner supply section (not shown) to the conductive sleeve 12. The toner 14 contains magnetic powder in about a half proportion, and it is therefore magnetically attracted to the conductive sleeve 12 formed of magnets. The toner 14 attracted to the conductive sleeve 12 is carried to a position opposed to the photosensitive drum 11 by rotation of the conductive sleeve 12 in a direction depicted by an arrow P. During this course, the toner 14 on the conductive sleeve 12 is scraped to form a thin toner layer 15 by a magnetic blade 13 provided in the vicinity of the conductive sleeve 12. At this time, particles of the toner 14 are vigorously rubbed with each other or with the surface of the conductive sleeve 12 with the result that the particles are negatively charged. Thus, the thin toner layer 15 negatively charged is formed on the conductive sleeve 12 at a portion thereof opposed to the photosensitive drum 11.

Prior to exposure, the photosensitive drum 11 is uniformly negatively charged by a charge corotron (not shown). As being rotated in a direction depicted by an arrow Q, the surface of the photosensitive drum 11 is sequentially exposed to light according to image information. Owing to this exposure according to the image information, an exposed area on the surface of the photosensitive drum 11 is neutralized in electric charge, but an unexposed area on the surface of the photosensitive drum 11 remains negative in electric charge. Accordingly, an electrostatic latent image 16 is formed on the exposed area on the surface of the photosensitive drum 11. At this time, the unexposed area on the photosensitive drum 11 has a potential of about −300 V and the exposed area on the photosensitive drum 11 has a potential of several tens of minus volts.

A developing bias is applied to the conductive sleeve 12, so as to make the negatively charged toner jump to the photosensitive drum 11. The developing bias is obtained by superimposing a DC voltage component generated from a DC voltage generating circuit 17 and an AC voltage component generated from an AC voltage generating circuit 18. The AC voltage component is applied for the purpose of always reciprocating the toner between the conductive sleeve 12 and the photosensitive drum 11, which is characteristic of the jumping development process. On the other hand, the DC voltage component is applied for the purpose of making the toner 14 supplied to the photosensitive drum 11 by the AC voltage component cling to to the exposed area on the photosensitive drum 11, thereby forming a toner image on the exposed area.

FIG. 9 shows a typical waveform of a developing bias 31 in the jumping development process. A DC voltage component 32 of the developing bias 31 is set at a potential of about −200 V corresponding to an intermediate potential between a potential 33 in the unexposed area of the photosensitive drum 11 and a potential 34 in the exposed area of the photosensitive drum 11. An AC voltage component of the developing bias 1 is represented by a sine wave having an amplitude of about 2 kV and a frequency of several kilohertz. In the phases shown by hatched areas in FIG. 9, the potential of the developing bias 31 is lower than the surface potential of the photosensitive drum 11, and the toner has jumped to the photosensitive drum 11. Conversely, in the phase where the potential of the developing bias 31 is an enough high positive value, the toner has returned from the photosensitive drum 11 to the developing unit.

FIG. 10 shows a conventional developing bias generating section for generating such a developing bias. The developing bias generating section includes a CPU (Central Processing Unit) 51 for controlling on/off switching of the developing bias and an oscillating circuit 52 adapted to oscillate under control of the CPU 51.

The CPU 51 generates a developing bias on/off signal 53 to an output controller 54 at a given timing according to a program stored in a memory (not shown). The output controller 54 includes a power supply for oscillating the oscillating circuit 52, and switches the power supply according to the developing bias on/off signal 53 output from the CPU 51.

The oscillating circuit 52 is composed of a capacitor 55, a primary wiring inductance of a transformer 56, and a transistor 57. When receiving an on-signal from the CPU 51, the output controller 54 switches on the power supply to set given potentials at output terminals 58 and 59, thereby starting oscillation of the oscillating circuit 52. Conversely, when receiving an off-signal from the CPU 51, the output controller 54 switches off the power supply to stop the oscillation of the oscillating circuit 52.

A capacitor 60 and a diode 61 are connected to a secondary wiring of the transformer 56, and resistors 62 and 63 are also connected to form a closed circuit. When the oscillating circuit 52 starts oscillating, electric charges are stored into the capacitor 60. An electric current is allowed to flow only clockwise in the closed circuit through the diode 61, so that a potential of a developing bias 64 is shifted in the negative direction by the electric charges stored in the capacitor 60.

In other words, a negative DC voltage component is generated by the capacitor 60. Thus, the DC voltage component is superimposed with an AC voltage component to obtain the developing bias 64.

While a semiconductor laser is used as a light source for exposing the photosensitive drum, an output level of the semiconductor laser greatly fluctuates because of a change in ambient temperature or an aged factor. To compensate such a fluctuation in output level of the semiconductor laser, feedback control is usually performed. In the feedback control, the semiconductor laser is driven by a given drive current for adjustment and a gain of a drive circuit is so adjusted as to make the output constant. Such a light intensity adjustment is periodically performed to thereby maintain the output level of the semiconductor laser always at a constant value.

The light intensity adjustment as mentioned above is inhibited while the photosensitive drum is being exposed according to image information. There is disclosed in Japanese Patent Laid-open No. 2-134656 an image forming apparatus wherein the light intensity adjustment is performed in an area on a photosensitive member to be scanned by a laser beam output from the semiconductor laser during a time period when the scanning is suspended. In such an image forming apparatus, an intended reduction in print time brings about insufficiency of time for the light intensity adjustment. Accordingly, it is difficult to maintain an image quality.

In contrast, there is disclosed in Japanese Patent Laid-open No. 2-131261 an electrophotographic printer wherein the light intensity adjustment is performed at a given timing between the exposures according to image information. In such an electrophotographic printer, a meaningless electrostatic latent image unrelated to the image information is undesirably formed on the photosensitive drum by the adjusting light from the semiconductor laser. If the meaningless electrostatic latent image is developed, not only the toner is wastefully consumed, but also a transferring unit is stained with the toner. Further, in an image forming apparatus adopting a constant transfer system, a back surface of a recording paper is stained. To solve this problem, the electrophotographic printer disclosed in Japanese Patent Laid-open No. 2-131261 mentioned above controls the potential of the developing bias to a given value at which the meaningless electrostatic latent image cannot be developed during a time period when the meaningless electrostatic latent image passes a position opposed to the developing unit.

Thus in the conventional image forming apparatus adapted to perform the light intensity adjustment during a time period between the exposures according to image information, development of the meaningless electrostatic latent image unrelated to the image information can be prevented by controlling the potential of the developing bias.

FIGS. 11A to 11C show various signal waveforms when the developing bias is turned off irrespective of the phase of the AC voltage component as in the related art. More specifically, FIG. 11A shows a waveform of the developing bias, in which hatched areas represent the phases where the toner has jumped to the photosensitive drum. FIG. 11B shows a developing bias on/off signal, in which when this signal is H (high) level, the developing bias is on whereas when this signal is L (low) level, the developing bias is off. FIG. 11C shows an output signal from the semiconductor laser, in which when this signal is H level, the semiconductor laser is on.

Initially, the developing bias same as that shown in FIG. 9 is applied to the conductive sleeve. In this condition, the semiconductor laser remains off, and the photosensitive drum is therefore unexposed. When performing the light intensity adjustment, the CPU changes the developing bias on/off signal from H level to L level, thereby turning off the developing bias. In the case shown in FIGS. 11A to 11C, the developing bias is turned off in the phase represented by the rightmost hatched area, that is, in the phase where the toner has jumped to the photosensitive drum but has not yet returned to the developing unit. In other words, the toner is left on the photosensitive drum in this phase. Thus, when the developing bias is turned off irrespective of the phase of the AC voltage component, there is a possibility that the toner may be left on the photosensitive drum. As a result, there remains the above problem of wasteful consumption of the toner and staining of the transferring unit. Such a problem occurs not only when the light intensity adjustment is performed but also whenever the developing bias is turned off.

SUMMARY OF THE INVENTION

It is accordingly an object of the present invention to provide an image forming apparatus which can prevent a toner from being left on a photosensitive member when a developing bias is turned off.

It is another object of the present invention to provide an image forming apparatus which can perform the light intensity adjustment during a time internal when printing is not carried out and can prevent a toner from being left on a photosensitive member in performing the light intensity adjustment.

According to a first aspect of the present invention, there is provided an image forming apparatus comprising a photosensitive member; a light source for exposing the photosensitive member according to input image information; a developing unit located in the vicinity of the photosensitive member with a gap defined therebetween, for making a charged toner jump to the photosensitive member and developing an electrostatic latent image formed on the photosensitive member; developing bias applying means for applying to the gap defined between the developing unit and the photosensitive member a developing bias comprising an AC voltage component for reciprocating the charged toner between the developing unit and the photosensitive member and a DC voltage component for developing the electrostatic latent image; developing bias application control means for controlling on/off switching of the developing bias to be applied by the developing bias applying means; phase detecting means for detecting whether a phase of the developing bias is a toner return phase in which the charged toner has returned from the photosensitive member to the developing unit; and off-time phase control means for turning off the developing bias in the toner return phase according to a detection result output from the phase detecting means.

With this arrangement, the charged toner is reciprocated between the developing unit and the photosensitive member by the AC voltage component of the developing bias, and the electrostatic latent image is developed by the DC voltage component of the developing bias. Further, the phase detecting means detects the phase of the developing bias vibrating with time, and the off-time phase control means receives an output signal from the phase detecting means and controls the phase in which the developing bias is turned off. Specifically, the off-time phase control means controls the phase according to the output signal from the phase detecting means so that the developing bias is turned off always in the phase where the toner has returned from the photosensitive member to the developing unit. Accordingly, the toner can be prevented from being left on the photosensitive member when the developing bias is turned off.

According to a second aspect of the present invention, there is provided an image forming apparatus comprising a photosensitive member; a laser light source for exposing the photosensitive member according to input image information; light intensity adjusting means for performing light intensity adjustment by compensating a fluctuation in output level of the laser light source in a time period between exposures per page performed by the laser light source according to the input image information; a developing unit located in the vicinity of the photosensitive member with a gap defined therebetween, for making a charged toner jump to the photosensitive member and developing an electrostatic latent image formed on the photosensitive member; developing bias applying means for applying to the gap defined between the developing unit and the photosensitive member a developing bias comprising an AC voltage component for reciprocating the charged toner between the developing unit and the photosensitive member and a DC voltage component for developing the electrostatic latent image; developing bias application control means for controlling on/off switching of the developing bias to be applied by the developing bias applying means so that only the electrostatic latent image formed according to the input image information is developed and another electrostatic latent image formed in association with the light intensity adjustment is not developed; phase detecting means for detecting whether a phase of the developing bias is a toner return phase in which the charged toner has returned from the photosensitive member to the developing unit; and off-time phase control means for turning off the developing bias in the toner return phase according to a detection result output from the phase detecting means.

With this arrangement, the exposure per input image information corresponding to each page of a recording paper is performed, and the light intensity adjustment is performed in a time period between the exposures per page by compensating a fluctuation in output level of the laser light source. Further, when a surface area of the photosensitive member on which a meaningless electrostatic latent image is formed in association with the light intensity adjustment faces the developing unit, the developing bias is turned off to prevent the meaningless electrostatic latent image from being developed. Further, the developing bias is turned off in the phase where the toner has returned to the developing unit, thereby preventing the toner from being left on the photosensitive member.

According to a third aspect of the present invention, there is provided an image forming apparatus comprising a photosensitive member; a laser light source for exposing the photosensitive member according to input image information; light intensity adjusting means for performing light intensity adjustment by compensating a fluctuation in output level of the laser light source in a time period between exposures per page performed by the laser light source according to the input image information; a developing unit located in the vicinity of the photosensitive member with a gap defined therebetween, for making a charged toner jump to the photosensitive member and developing an electrostatic latent image formed on the photosensitive member; developing bias applying means capable of independently applying to the gap defined between the developing unit and the photosensitive member an AC voltage for reciprocating the charged toner between the developing unit and the photosensitive member and a DC voltage for developing the electrostatic latent image; and developing bias application control means for controlling on/off switching of the DC voltage so that only the electrostatic latent image formed according to the input image information is developed and another electrostatic latent image formed in association with the light intensity adjustment is not developed.

With this arrangement, the developing bias applying means can independently apply the AC voltage and the DC voltage to the developing unit. When a meaningless electrostatic latent image formed on the photosensitive member in performing the light intensity adjustment faces the developing unit, the DC voltage is turned off to prevent the meaningless electrostatic latent image from being developed. Further, the AC voltage is kept applied to continue the reciprocating motion of the toner between the developing unit and the photosensitive member, thereby preventing the toner from being left on the photosensitive drum.

As described above, according to the first aspect of the present invention, the phase detecting means for detecting the phase of the developing bias and the off-time phase control means for controlling a timing of turning off the developing bias according to a detection result output from the phase detecting means are provided to thereby turn off the developing bias in the phase where the toner has returned to the developing unit. Accordingly, the toner can be prevented from being left on the photosensitive member when the developing bias is turned off.

According to the second aspect of the present invention, the light intensity adjusting means for compensating a fluctuation in output level of the laser light source is provided to perform the light intensity adjustment in a time period between the exposures per page relating to the input image information, thereby stabilizing the output from the laser light source without hindering the development of an intended electrostatic latent image formed on the photosensitive member. Further, when a meaningless electrostatic latent image formed on the photosensitive member in association with the light intensity adjustment faces the developing unit, the developing bias is turned off to thereby prevent the development of the meaningless electrostatic latent image. Further, the developing bias is turned off in the phase where the toner has returned to the developing unit, thereby preventing the toner from being left on the photosensitive member.

According to the third aspect of the present invention, the developing bias applying means capable of independently applying the AC voltage and the DC voltage is provided, and when a meaningless electrostatic latent image formed on the photosensitive member in performing the light intensity adjustment faces the developing unit, the DC voltage is turned off to thereby prevent the development of the meaningless electrostatic latent image. Further, since the AC voltage continues to be applied also in the off-state of the DC voltage, the toner can be reciprocated between the developing unit and the photosensitive member. Accordingly, the toner can be prevented from being left on the photosensitive member without the need of detecting the phase of the developing bias or controlling the off-timing of the developing bias according to the detection result of the phase.

Other objects and features of the invention will be more fully understood from the following detailed description and appended claims when taken with the accompanying drawings.

BRIEF DESCRIPTION OF THE DRAWINGS

FIG. 7A is a waveform chart of a developing bias in the second preferred embodiment when a DC voltage component of the developing bias is turned off;

FIG. 7B is a timing chart of a developing bias DC voltage on/off signal in relation to FIG. 7A;

FIG. 7C is a timing chart of a laser output signal in relation to FIG. 7A;

FIG. 8 is an enlarged view illustrating the principle of operation of a jumping development process;

DETAILED DESCRIPTION OF THE PREFERRED EMBODIMENTS

Figure 2:
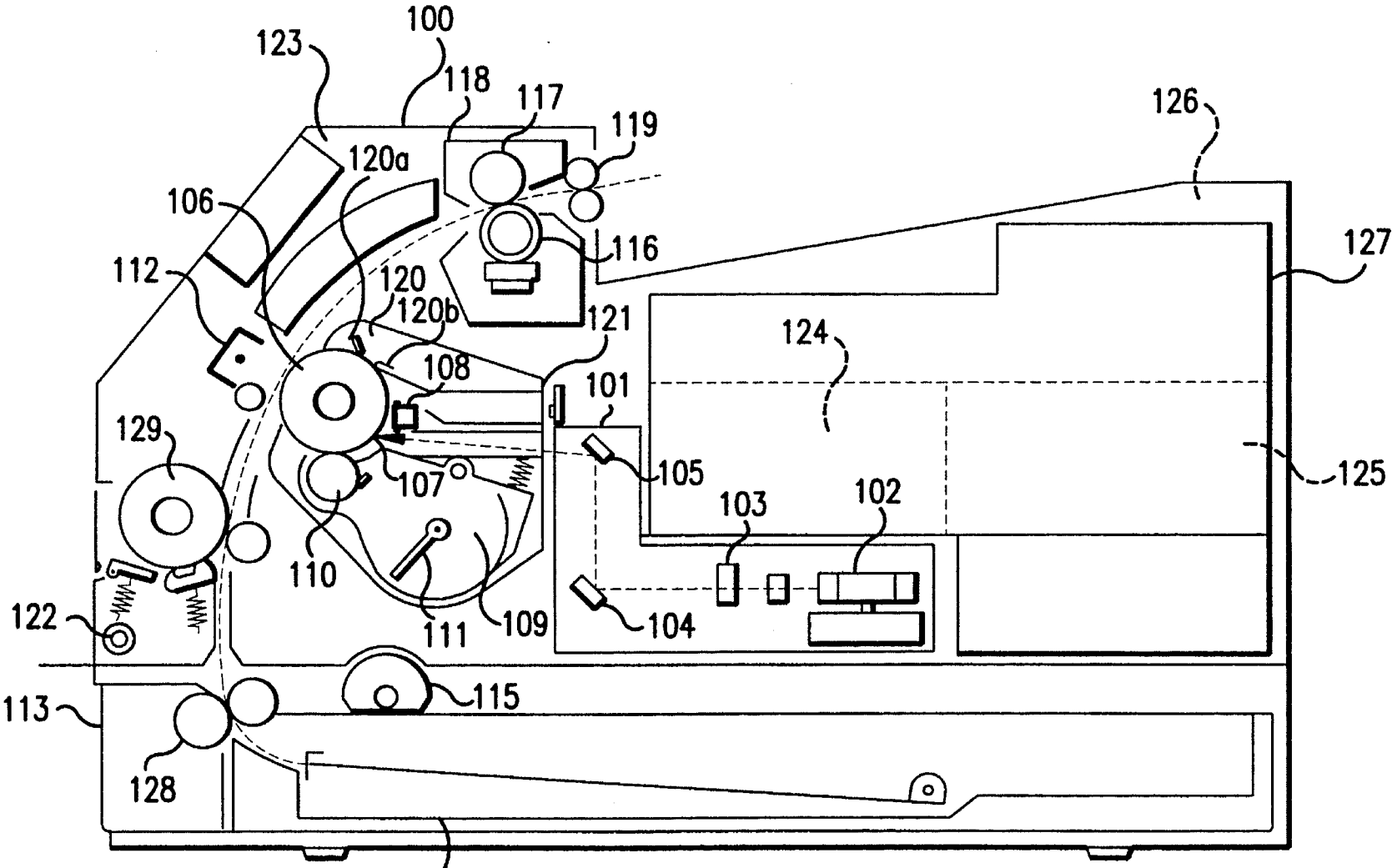
FIG. 2 is a schematic sectional side view of a laser beam printer according to the present invention.

Referring first to FIG. 2, there is shown a schematic illustration of a laser beam printer 100 as an image forming apparatus according to a first preferred embodiment of the present invention. The laser beam printer 100 is shown in sectional side elevation, in which the left-hand side as viewed in FIG. 2 is a front side of the laser beam printer 100.

The laser beam printer 100 includes a laser scanner 101. The laser scanner 101 includes a semiconductor laser (not shown) for generating a modulated laser beam according to image information input. The laser beam generated from the semiconductor laser is incident on a rotating polygon mirror 102, and is deflected according to rotation of the polygon mirror 102. The deflected laser beam is allowed to pass through an fθ lens 103 and is then changed in direction of advance by two mirrors 104 and 105. Thereafter, the reflected laser beam is output from the laser scanner 101.

A photosensitive drum 106 is located on an extension of the laser beam output from the laser scanner 101. The photosensitive drum 106 is adapted to rotate at a constant speed in a direction depicted by an arrow X. The laser beam output from the laser scanner 101 repeatedly scans a given exposure position 107 on the photosensitive drum 106 in an axial direction thereof, that is, in a horizontal scanning direction. A charge corotron 108 is located at a position immediately upstream of the exposure position 107 with respect to the X direction in such a manner as to face the photosensitive drum 106. The charge corotron 108 functions to uniformly charge the cylindrical surface of the photosensitive drum 106. After the photosensitive drum 106 is charged by the charge corotron 108, the laser beam is directed on the photosensitive drum 106 at the exposure position 107, thereby forming an electrostatic latent image corresponding to the image information on the surface of the photosensitive drum 106. The electrostatic latent image is developed to form a toner image on the surface of the photosensitive drum 106 by a developing unit 109 located at a position just downstream of the exposure position 107 with respect to the X direction. The developing unit 109 includes a toner container 109*a* for storing a toner, a developing roll 110 for magnetically carrying the toner and developing the electrostatic latent image, and a toner supplying mechanism 111 for supplying the toner stored in the toner container 109*a* to the developing roll 110. A given developing bias is preliminarily applied to the developing roll 110.

The toner image formed by development operation of the developing unit 109 is moved to a position opposed to a transfer corotron 112 by the rotation of the photosensitive drum 106. At this position, the toner image on the surface of the photosensitive drum 106 is electrostatically transferred to a recording paper (plain paper) by the transfer corotron 112. Both the charge corotron 108 and the transfer corotron 112 used in this preferred embodiment have such a structure that a single corotron wire is stretched in a space defined by a shielding member, and a voltage applying terminal is provided at one end of the corotron wire.

A feed path of the recording paper will now be described in brief. A paper feeder 113 is detachably mounted on the bottom of the laser beam printer 100, and a cassette tray 114 is removably incorporated in the paper feeder 113 in such a manner as to be inserted therein from the front side. A plurality of sheets of paper (not shown) as the recording paper are stacked in the cassette tray 114. An uppermost one of the sheets of paper stacked in the cassette tray 114 is drawn from the tray 114 by a semilunar roll 115 having a semilunar shape. The semilunar roll 115 may be replaced with a retard roll or any other feeding means.

The recording paper drawn from the cassette tray 114 by the semilunar roll 115 is fed by a feed roll 128 to advance in a feed path as shown by a broken line. When a leading end of the recording paper reaches a register roll 129, rotation of the register roll 129 is once stopped to stop the advance of the recording paper. Thereafter, in synchronism with a desired rotational position of the photosensitive drum 106, the rotation of the register roll 129 is restarted by an electromagnetic clutch not shown, thereby feeding the recording paper stably at a constant speed. Accordingly, the recording paper is allowed to pass between the photosensitive drum 106 and the transfer corotron 112 at a desired timing. During pass of the recording paper between the photosensitive drum 106 and the transfer corotron 112, the transfer corotron 112 performs discharging to thereby electrostatically attract the toner image formed on the photosensitive drum 106 toward the transfer corotron 112, thus transferring the toner image onto the recording paper. Just after transfer of the toner image, the charges on the recording paper are removed from its back surface by a static eliminator (not shown) located downstream of the transfer corotron 112, thereby separating the recording paper from the surface of the photosensitive drum 106. The recording paper separated from the photosensitive drum 106 is traveled a given distance in the feed path for the purpose of relaxation. Thereafter, the recording paper reaches a fixing unit 118 consisting of a heat roll 116 and a pressure roll 117. In the fixing unit 118, the recording paper is allowed to pass between the heat roll 116 and the pressure roll 117 contacting each other with a given nip width. At this time, a surface of the recording paper on which the toner image has been transferred faces the heat roll 116, and the recording paper is pressed from its other surface by the pressure roll 117 against the heat roll 116, thus efficiently transmitting heat. The heat roll 116 is controlled to maintain a constant high temperature. In this condition, the toner image on the recording paper is fused by the heat to be fixed.

After fixing of the toner image, the recording paper is fed to an eject roll 119 located downstream of the fixing unit 118, and is ejected to an upper portion of the laser beam printer 100 by the eject roll 119. The surface of the recording paper on which the toner image has been recorded in the above manner faces down after ejection by the eject roll 119. Accordingly, the sheets of paper thus recorded per page are stacked on the upper portion of the laser beam printer 100 with the recorded surface of each sheet facing down, so that the stack of the sheets of recorded paper can be fastened as it is with a stapler or the like.

An excess toner that has not been transferred onto the recording paper is removed from the surface of the photosensitive drum 106 by a cleaning unit 120 located downstream of the transfer corotron 112. The cleaning unit 120 includes a blade **120*b* for scraping the excess toner from the surface of the photosensitive drum 106 and a film 120*a*** for preventing leak of the toner.

In the laser beam printer 100 according to this preferred embodiment, all of the photosensitive drum 106, the cleaning unit 120, the charge corotron 108, and the developing unit 109 are integrated as an EP cartridge 121. Further, the laser beam printer 100 according to this preferred embodiment has a front cover 123. The front cover 123 is pivotally supported to hinges 122 so as to open and close about the hinges 122. In an open condition of the front cover 123, a user can easily carry out removal of paper jamming and replacement of the EP cartridge 121 or the transfer corotron 112. Further, the user can also easily mount and demount the fixing unit 118 to and from the laser beam printer 100 according to this preferred embodiment.

A power supply section 124 consisting of a low-voltage supply and a high-voltage supply is located behind the laser scanner 101 to supply a required electric power to each component. A control section 125 is located behind the power supply section 124 to perform electrical control of the laser beam printer 100. An image information processing section 126 is located over the power supply section 124 and the control section 125 to translate the image information transferred from a computer or the like into a language for the laser beam printer 100 and feed the language to the control section 125.

Figure 1:
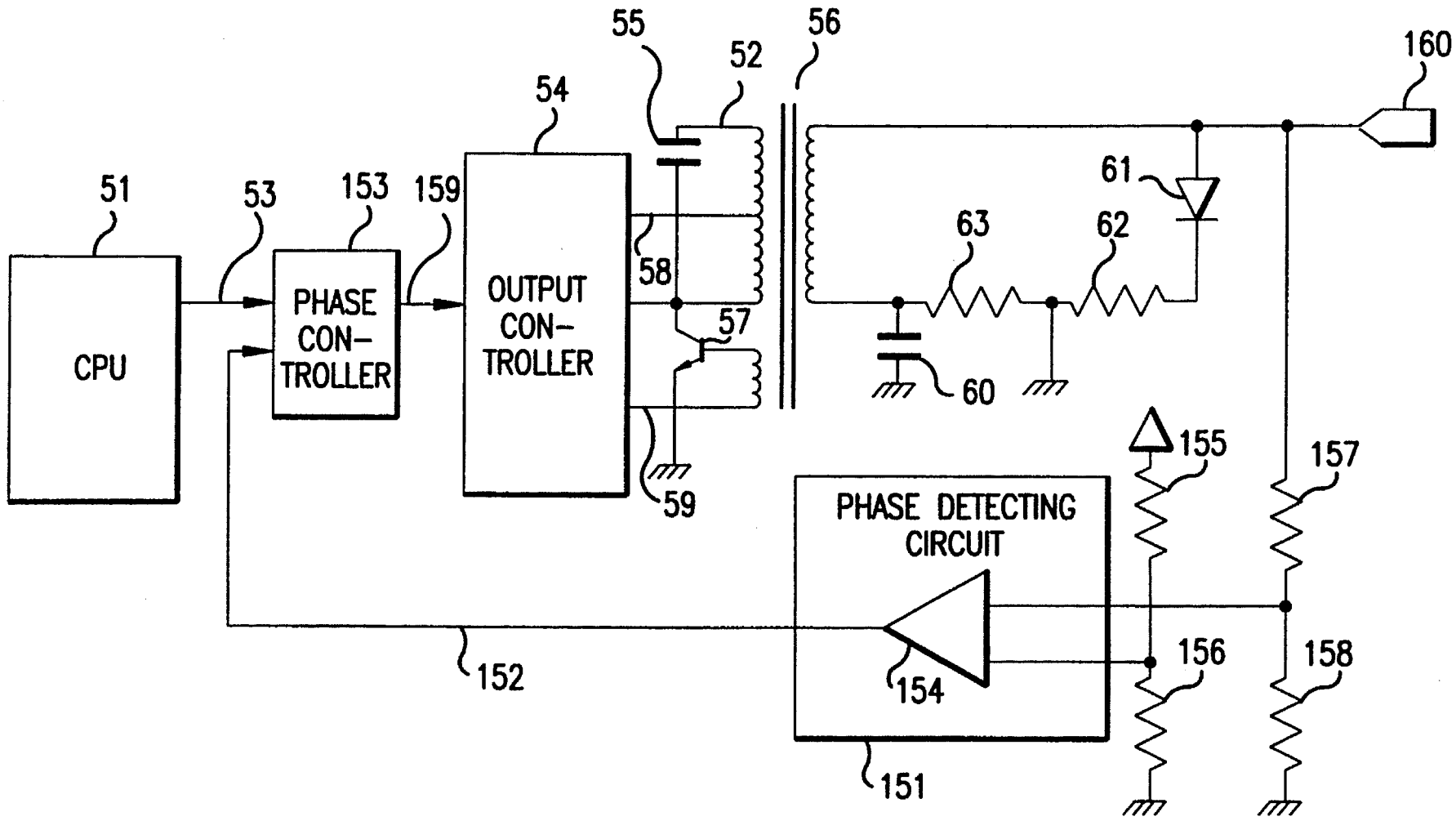
FIG. 1 is a schematic block diagram of a developing bias generating section in a first preferred embodiment of the present invention.
Figure 10:
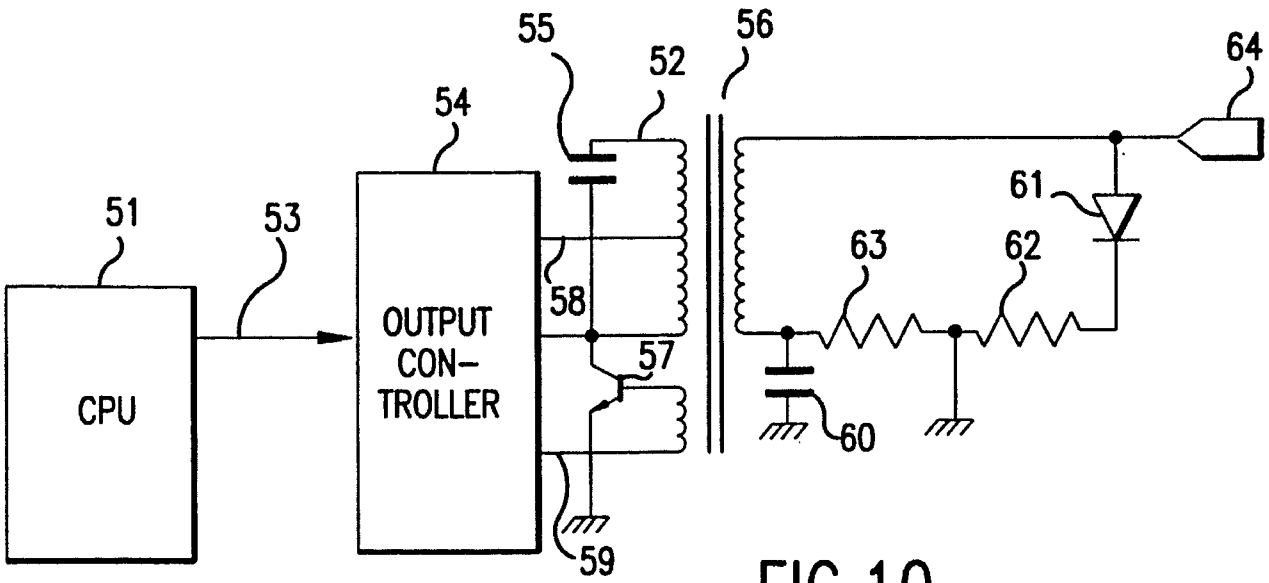
FIG.10 RELATED ART
FIG. 10 is a schematic block diagram of a conventional developing bias generating section for generating the developing bias in the jumping development process.
Figure 11A:
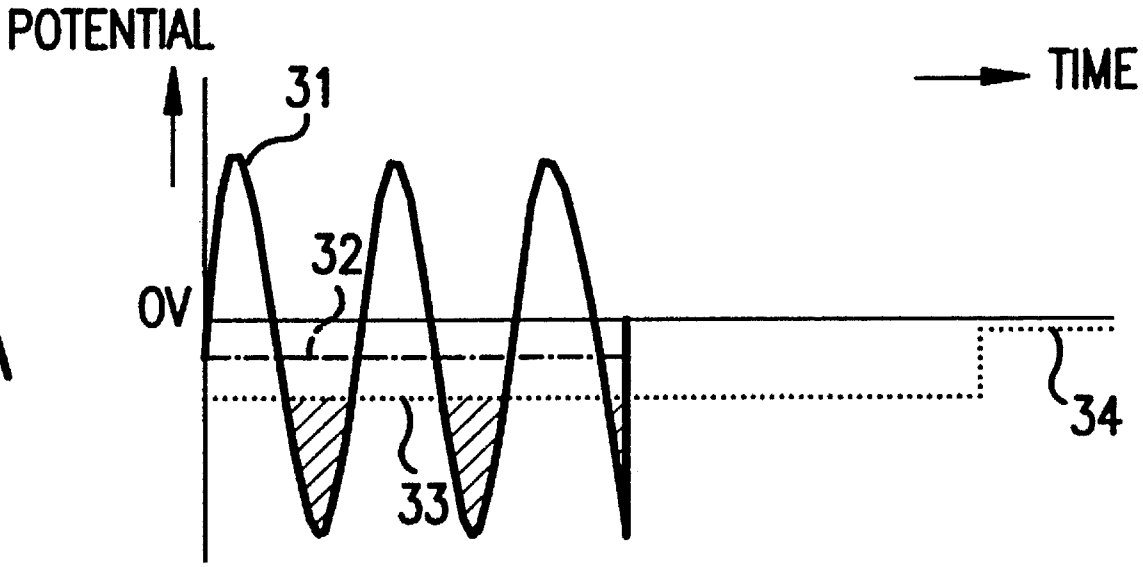
FIG.11A RELATED ART
FIG. 11A is a waveform chart of the developing bias in the related art when the developing bias is turned off irrespective of a phase of an AC voltage component of the developing bias.
Figure 11B:
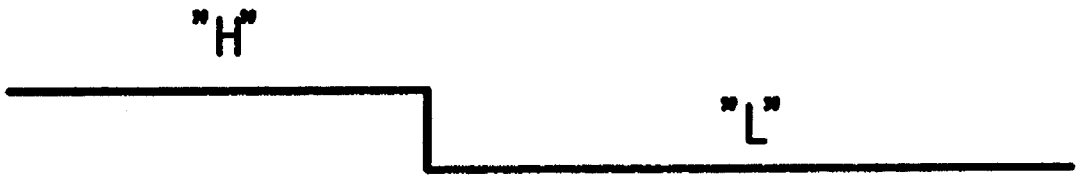
FIG.11B RELATED ART
FIG. 11B is a timing chart of a developing bias on/off signal in relation to FIG. 11A.
Figure 11C:
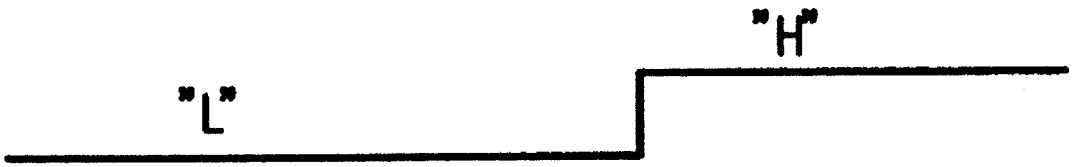
FIG.11C RELATED ART
FIG. 11C is a timing chart of a laser output signal in relation to FIG. 11A.

Referring to FIG. 1, there is shown a developing bias generating section provided as a part of the electrical components of the laser beam printer as mentioned above. In FIG. 1, the same parts as those shown in FIG. 10 are denoted by the same reference numerals, and the explanation thereof will be omitted as required. The developing bias generating section shown in FIG. 1 includes a phase detecting circuit 151 for detecting a phase of a developing bias 160 and a phase controller 153 for controlling a timing so that the developing bias 160 becomes on or off in a predetermined phase in receipt of a phase detection signal 152 output from the phase detecting circuit 151.

The phase detecting circuit 151 includes a comparator 154 for comparing the developing bias 160 with a given reference potential. The reference potential is generated by dividing a supply voltage by resistors 155 and 156, and is input into one of input terminals of the comparator 154. The developing bias 160 is divided by resistors 157 and 158 to generate a voltage signal, which is input into the other input terminal of the comparator 154. Assuming that a developing bias at a time t is represented as V(t) and the resistor 155 is connected to a voltage supply at a potential $V_{ref}$, and letting $R_{155}$, $R_{156}$, $R_{157}$ and $R_{158}$denote resistances of the resistors 155, 156, 157 and 158, respectively, the phase detection signal 152 to be output from the comparator 154 becomes H (high) level when the following inequality (1) holds, whereas the phase detection signal 152 becomes L (low) level otherwise.

$$V(t) > \frac{1 + R_{157}/R_{158}}{1 + R_{155}/R_{156}} V_{ref} \quad (1)$$

Accordingly, a threshold of the developing bias at which the output level of the comparator 154 changes can be set to a desired potential by changing these resistances $R_{155}$ to $R_{158}$. Alternatively, variable resistors may be used as these resistors 155 to 158 to allow free adjustment of the desired potential even after installation of the circuit. In this preferred embodiment, the resistor 155 is grounded to set the potential $V_{ref}$ to zero. Accordingly, when the developing bias is positive, the phase detection signal 152 becomes H level, whereas otherwise it becomes L level. Further, the term of "toner return phase" of the developing bias to be detected by the phase detecting means in the present invention means a phase in which an electric field formed between the photosensitive member and the developing unit is directed to the photosensitive member when the toner is negatively charged, whereas the term means a phase in which the electric field is directed to the developing unit when the toner is positively charged. In both cases of the negatively charged toner and the positively charged toner, it is preferable to turn off the developing bias applied to the developing unit until the phase of an AC voltage component of the developing bias becomes 45 degrees after the AC voltage component reaches a peak.

A developing bias on/off signal 53 is output from a CPU (Central Processing Unit) 51. The developing bias on/off signal 53 output from the CPU 51 and the phase detection signal 152 output from the phase detecting circuit 151 are input to the phase controller 153. When the developing bias is turned on, the developing bias on/off signal 53 to be output from the CPU 51 becomes H level, whereas when the developing bias is turned off, the developing bias on/off signal 53 becomes L level.

The operation upon turning off the developing bias will now be described. When the developing bias is on, an output from the phase controller 153, that is, a phase-controlled developing bias on/off signal 159 is H level. When the developing bias on/off signal 53 from the CPU 51 becomes L level, the phase controller 153 changes the phase-controlled developing bias on/off signal 159 from H level to L level at a timing when the phase detection signal 152 from the phase detecting circuit 151 changes from H level to L level for the first time after the signal 53 becomes L level. Accordingly, the developing bias is turned off always in the toner return phase.

On the other hand, the operation upon turning on the developing bias does not include such timing control. That is, when the developing bias on/off signal 53 from the CPU 51 becomes H level, the phase controller 153 immediately changes the phase-controlled developing bias on/off signal 159 from L level to H level.

An output controller 54 controls an oscillating circuit 52 according to the phase-controlled developing bias on/off signal 159 output from the phase controller 153. When the phase-controlled developing bias on/off signal 159 becomes H level, the output controller 54 switches on a power supply provided as a part of the controller 54 and sets predetermined potentials at output terminals 58 and 59. Accordingly, the oscillating circuit 52 starts oscillating. Conversely, when the phase-controlled developing bias on/off signal 159 becomes L level, the output controller 54 switches off the power supply to stop the oscillation of the oscillating circuit 52.

Figures 3A, 3B, 3C, 3D, 4A, 4B, 4C:
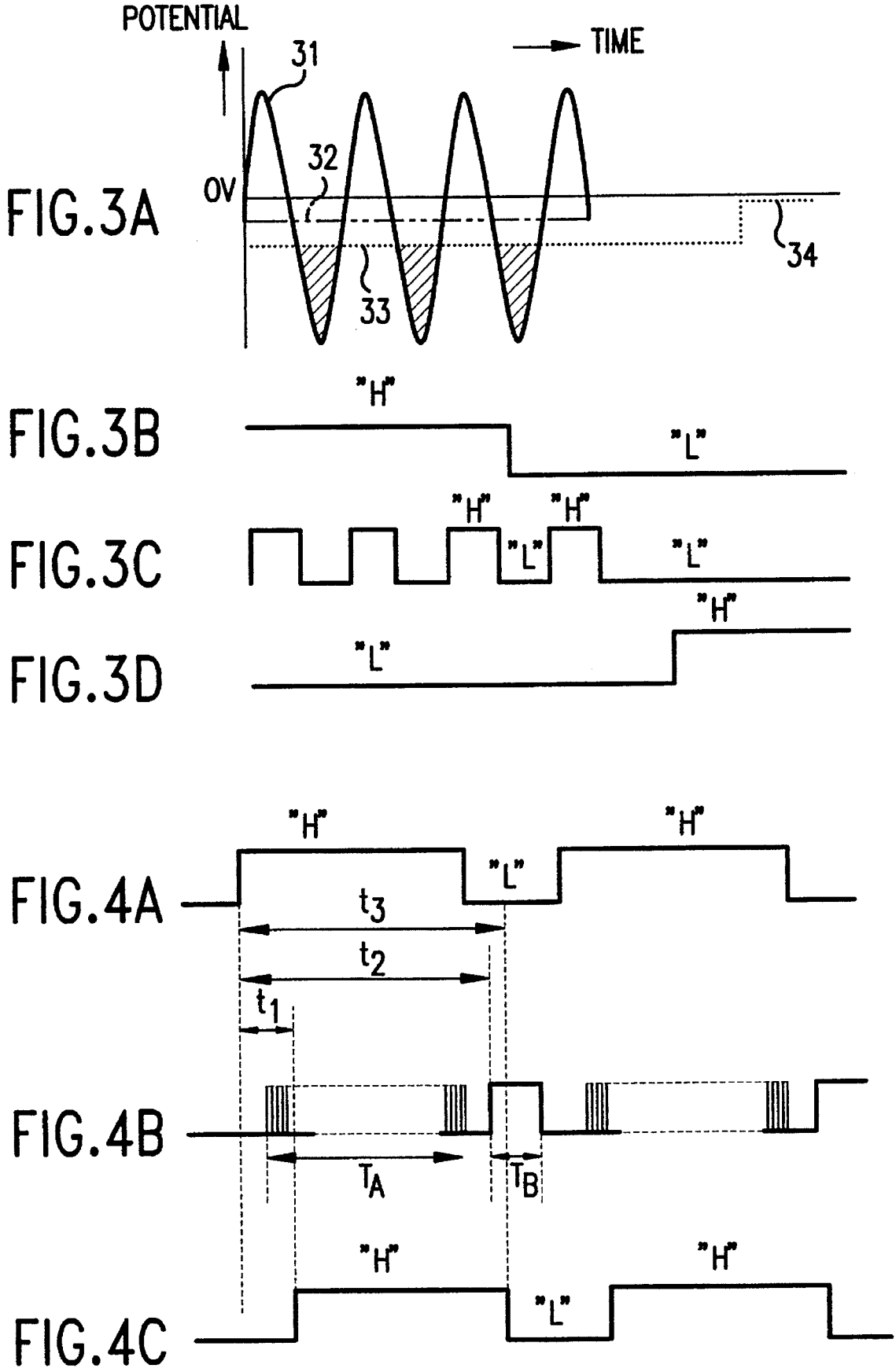
FIG. 3A is a waveform chart of a developing bias in the first preferred embodiment when the developing bias is turned off.
FIG. 3B is a timing chart of a developing bias on/off signal in relation to FIG. 3A.
FIG. 3C is a timing chart of a phase detection signal in relation to FIG. 3A.
FIG. 3D is a timing chart of a laser output signal in relation to FIG. 3A.
FIG. 4A is a waveform chart of an output signal from a paper sensor in the first preferred embodiment.
FIG. 4B is a timing chart of a laser output signal in performing the light intensity adjustment in relation to FIG. 4A.
FIG. 4C is a timing chart of a developing bias on/off signal in relation to FIG. 4A.

FIGS. 3A to 3D show various signal waveforms when the developing bias is turned off in the developing bias generating section according to this preferred embodiment. More specifically, FIG. 3A shows a waveform of a developing bias 31, in which hatched areas represent phases where the toner has jumped to the photosensitive drum; FIG. 3B shows a change of the developing bias on/off signal 159; FIG. 3C shows the phase detection signal 152, which periodically repeats H level and L level during the on-state of the developing bias; and FIG. 3D shows a change from the off-state to the on-state of the semiconductor laser, in which the on-state of the semiconductor laser is represented by H level.

Figure 9:
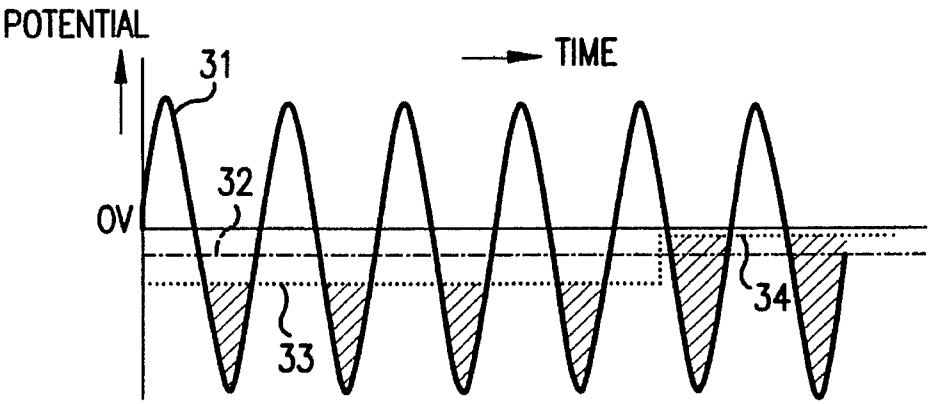
FIG.9 RELATED ART
FIG. 9 is a typical waveform chart of a developing bias in the jumping development process.

When the developing bias on/off signal 159 is H level, the developing bias 31 same as that shown in FIG. 9 is applied to the developing roll 110 as a conductive sleeve. In this condition, no output is generated from the semiconductor laser, and the photosensitive drum 106 is therefore unexposed. Further, only when the developing bias is positive, the phase detection signal 152 is H level. Suppose that the CPU 51 operates to change the developing bias on/off signal 159 from H level to L level as shown in FIG. 3B in order to perform the light intensity adjustment. Such a change of the output level is performed irrespective of the phase of the developing bias. In the case shown in FIGS. 3A to 3D, the output level becomes L level in the phase represented by the rightmost hatched area, that is, in the phase where the toner has jumped to the photosensitive drum 106 but has not yet returned to the developing roll 110. Accordingly, if the developing bias is turned off at the timing when the signal 159 is changed from H level to L level, the toner is undesirably left on the photosensitive drum 106. In this preferred embodiment, this problem is solved by the control such that the developing bias is turned off at the timing when the phase detection signal 152 changes from H level to L level for the first time after the developing bias on/off signal 159 becomes L level. Owing to this control, the toner is not left on the photosensitive drum 106 when the developing bias is turned off.

Although not shown, a paper sensor is provided in the vicinity of the feed path of the recording paper, and an output from the paper sensor is fed to the CPU 51. In this preferred embodiment, the light intensity adjustment is performed according to the output from the paper sensor when the main exposure relating to the image information is not performed. While the paper sensor does not detect the recording paper, the output from the paper sensor remains L level. When the leading end of the recording paper is detected by the paper sensor, the output from the paper sensor changes from L level to H level. When the trailing end of the recording paper after further fed is detected by the paper sensor, the output from the paper sensor returns from H level to L level.

The CPU 51 includes a first timer for setting a time internal from a timing when the leading end of the recording paper is detected by the paper sensor to a timing when the developing bias is turned on, a second timer for setting a time internal from the above timing of detection of the leading end of the recording paper to a timing when the light intensity adjustment is started, and a third timer for setting a time internal from the above timing of detection of the leading end of the recording paper to a timing when the developing bias is turned off. These timers are used for the control of on/off timings of the developing bias and a start timing of the light intensity adjustment by the CPU 51 according to a change in level of the output from the paper sensor. Further, the CPU 51 includes a ROM (Read Only Memory) and a RAM (Random Access Memory) to be used for the above-mentioned timing control of the developing bias and the light intensity adjustment by the CPU 51 according to a paper size of the recording paper.

FIGS. 4A to 4C show the on/off timings of the developing bias and the start timing of the light intensity adjustment in relation to the output signal from the paper sensor. More specifically, FIG. 4A shows the output signal from the paper sensor, in which H level represents the detection of the recording paper. A duration of the detection of the recording paper by the paper sensor depends on a paper size of the recording paper currently used in the laser beam printer. FIG. 4B shows a drive signal of the semiconductor laser, in which the main exposure is performed according to print data in a duration $T_A$ and the light intensity adjustment is performed in a duration $T_B$. FIG. 4C shows a change in level of the developing bias on/off signal 159.

As shown in FIGS. 4A to 4C, the time internal from the timing when the leading end of the recording paper is detected by the paper sensor to the timing when the developing bias is turned on is represented as a developing bias on-time $t_1$; the time internal from the above timing of detection of the leading end of the recording paper to the timing when the light intensity adjustment is started is represented as a light intensity adjustment start time $t_2$; and the time internal from the above timing of detection of the leading end of the recording paper to the timing when the developing bias is turned off is represented as a developing bias off-time $t_3$.

During a time internal from the timing when the leading end of the recording paper is detected by the paper sensor to the timing when the trailing end of the recording paper is detected by the paper sensor, printing is performed to disable the light intensity adjustment. Therefore, the light intensity adjustment must be started after the trailing end of the recording paper is detected by the paper sensor. As mentioned above, the above-mentioned time internal during which the paper sensor continues to detect the recording paper depends on the paper size of the recording paper.

In this regard, the CPU 51 determines the paper size of the recording paper from the kind of the cassette tray 114 set in the laser beam printer 100, and stores this information into the RAM. Further, the ROM preliminarily stores a table showing the relation between various paper sizes and various values of the timers $t_1$ to $t_3$ to be used corresponding to the paper sizes. Accordingly, when the output from the paper sensor becomes H level, the CPU 51 first reads the paper size of the recording paper set in the cassette tray 114 from the RAM, and then refers to the table stored in the ROM according to the paper size read above to decide the times $t_l$ to $t_3$. In this manner, the start of the light intensity adjustment and the on/off change of the developing bias can be performed at a proper timing in consideration of the paper size.

The developing bias on-time $t_1$ is set so that the developing bias is turned on just after transfer of the print data is started, that is, just after the main exposure is started by the semiconductor laser. The developing bias off-time $t_3$ is set so that the developing bias is turned off just after the light intensity adjustment is started.

Thus, in this preferred embodiment, when the paper sensor detects the leading end of the recording paper, the developing bias is first turned on, the light intensity adjustment is next started, and the developing bias is next turned off. Regarding the developing bias off-time $t_3$, if the development relating to the print data is ended, the developing bias may be turned off. Accordingly, the developing bias off-time $t_3$ may be set so that the developing bias is turned off just before the light intensity adjustment is started after completion of the main exposure.

Figure 5:
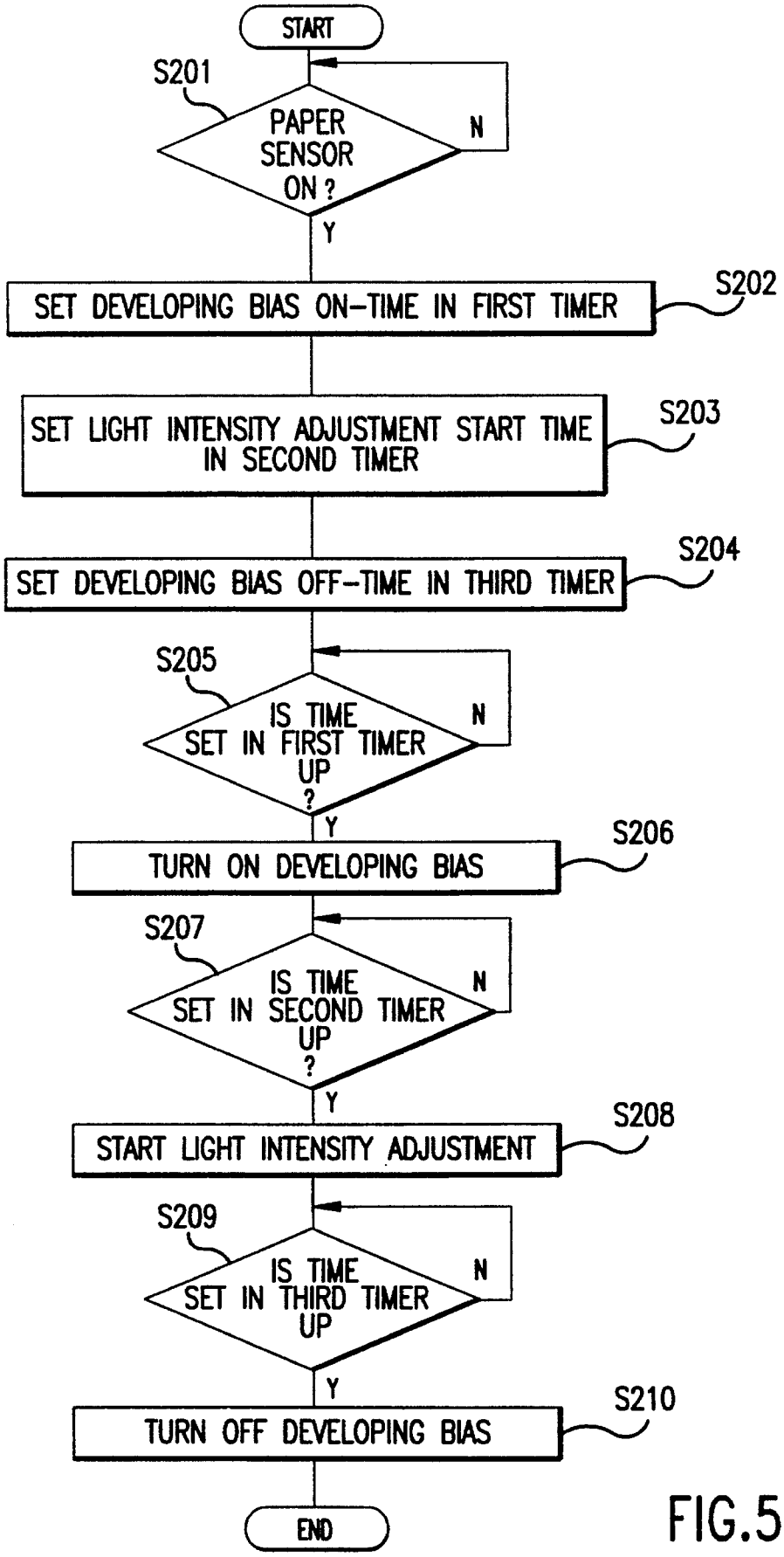
FIG. 5 is a flowchart showing the control of generation of on/off timings of the developing bias and a start timing of the light intensity adjustment in the first preferred embodiment.

FIG. 5 shows a flow of the control to be performed by the CPU 51 in generating the on/off timings of the developing bias and the start timing of the light intensity adjustment. When the leading end of the recording paper passes the paper sensor located in the vicinity of the feed path of the recording paper, the output from the paper sensor becomes H level. When the output from the paper sensor becomes H level (step S201: Yes), the CPU 51 first sets the developing bias on-time $t_1$ in the first timer (step S202), next sets the light intensity adjustment start time $t_2$ in the second timer (step S203), and next sets the developing bias off-time $t_3$ in the third timer (step S204). The setting of these times $t_1$ to $t_3$ is continuously performed, and a time for setting each of these times $t_1$ to $t_3$ is enough shorter than each of these times $t_1$ to $t_3$. Therefore, the order of the setting of these times $t_1$ to $t_3$ may be changed.

After ending the setting of the times $t_1$ to $t_3$ in the first to third timers, the CPU 51 starts monitoring whether or not the time $t_1$ set in the first timer is up (step S205). If the time $t_1$ is not up (step S205: No), the CPU 51 polls to continue this monitoring. If the time $t_1$ is up (step S205: Yes), the CPU 51 changes the developing bias on/off signal 159 from L level to H level (step S206). Accordingly, the developing bias is turned on.

Then, the CPU 51 starts monitoring whether or not the time $t_2$ set in the second timer is up (step S207). If the time $t_2$ is not up (step S207: No), the CPU 51 polls to continue this monitoring. If the time $t_2$ is up (step S207: Yes), the CPU 51 starts the light intensity adjustment (step S208).

Then, the CPU 51 starts monitoring whether or not the time $t_3$ set in the third timer is up (step S209). If the time $t_3$ is not up (step S209: No), the CPU 51 polls to continue this monitoring. If the time $t_3$ is up (step S209: Yes), the CPU 51 changes the developing bias on/off signal 159 from H level to L level (step S210). Accordingly, the developing bias is turned off.

According to this preferred embodiment as mentioned above, in performing the light intensity adjustment, the developing bias is turned off at a timing when the potential of the developing bias changes from a positive potential to a negative potential. Accordingly, the toner is prevented from being left on the photosensitive drum 106.

In the above-mentioned preferred embodiment, the developing bias as a whole is turned off to prevent an electrostatic latent image formed on the photosensitive drum 106 from being developed in performing the light intensity adjustment. However, whether or not the electrostatic latent image is developed depends on a DC voltage component of the developing bias. It is accordingly considered that only the DC voltage component may be turned off in performing the light intensity adjustment. In this case, an AC voltage component of the developing bias is always applied to the developing roll 110. Therefore, there is no possibility that the toner remains clinging to the photosensitive drum 106 irrespective of a timing of turning off the DC voltage component.

Figure 6:
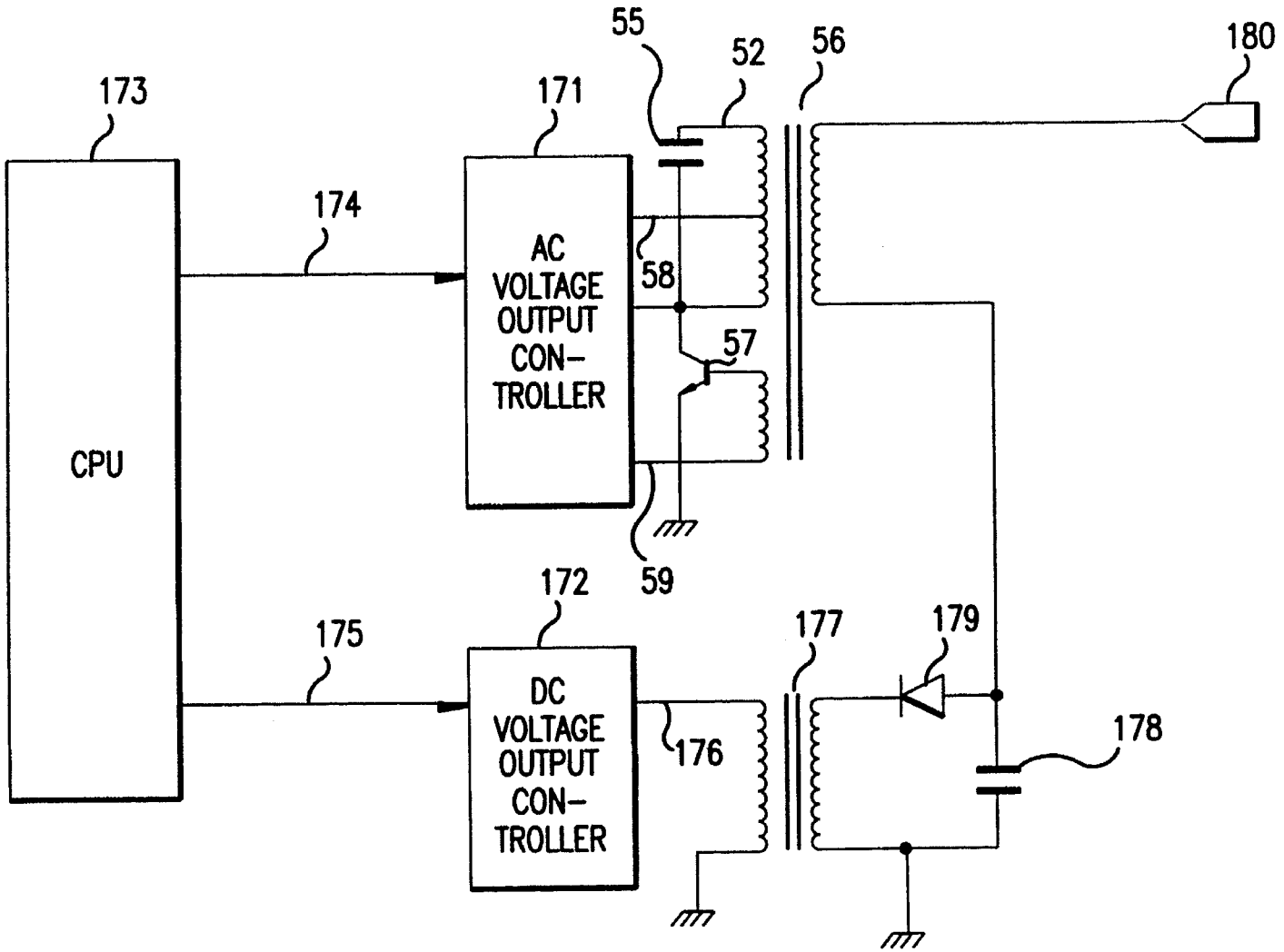
FIG. 6 is a schematic block diagram of a developing bias generating section in a second preferred embodiment of the present invention.

FIG. 6 shows a developing bias generating section according to a second preferred embodiment of the present invention on the basis of such a consideration. In FIG. 6, the same parts as those shown in FIG. 10 are denoted by the same reference numerals, and the explanation thereof will be omitted as required. In the second preferred embodiment, there are independently provided an AC voltage output controller 171 for switching the AC voltage component and a DC voltage output controller 172 for switching the DC voltage component. A CPU (Central Processing Unit) 173 independently generates a developing bias AC voltage on/off signal 174 for controlling the AC voltage output controller 171 and a developing bias DC voltage on/off signal 175 for controlling the DC voltage output controller 172. Accordingly, the on/off switching of the AC voltage component and the on/off switching of the DC voltage component can be independently controlled.

The AC voltage output controller 171 drives an oscillating circuit 52 according to the developing bias AC voltage on/off signal 174 output from the CPU 173. The operation of the output controller 171 is similar to that of the output controller 54 used in the conventional developing bias generating section. That is, when the developing bias AC voltage on/off signal 174 becomes H level, the oscillating circuit 52 starts oscillating, whereas when the signal 174 becomes L level, the oscillating circuit 52 stops oscillating.

When the developing bias DC voltage on/off signal 175 output from the CPU 173 becomes H level, the DC voltage output controller 172 generates an AC voltage to an output terminal 176. A capacitor 178 and a diode 179 are connected in series to a secondary wiring of a transformer 177 to form a closed circuit. The DC voltage component of the developing bias is made by electric charges stored in the capacitor 178. The electric current is allowed to flow only counterclockwise in the closed circuit through the diode 179, and the DC voltage component is therefore negative. On the other hand, when the developing bias DC voltage on/off signal 175 becomes L level, the DC voltage output controller 172 generates no AC voltage. Accordingly, the electric charges stored in the capacitor 178 to make the DC voltage component are discharged, so that the DC voltage component becomes zero.

In this manner, since the AC voltage output controller 171 and the DC voltage output controller 172 are independent of each other, the control of the AC voltage component and the control of the DC voltage component can be made independent. In this preferred embodiment, only the DC voltage component is turned off with the AC voltage component kept applied.

FIGS. 7A to 7C show various signal waveforms when the DC voltage component of the developing bias is turned off in the developing bias generating section according to the second preferred embodiment. More specifically, FIG. 7A shows a waveform of a developing bias 31, in which hatched areas represent phases where the toner has jumped to the photosensitive drum; FIG. 7B shows a change of the developing bias DC voltage on/off signal 175; and FIG. 7C shows a change from the off-state to the on-state of the semiconductor laser, in which the on-state of the semiconductor laser is represented by H level.

When the developing bias DC voltage on/off signal 175 is H level, the developing bias 31 same as that shown in FIG. 9 is applied to the developing roll as a conductive sleeve. In this condition, no output is generated from the semiconductor laser, and the photosensitive drum is therefore unexposed. Suppose that the CPU 173 operates to change the developing bias DC voltage on/off signal 175 from H level to L level as shown in FIG. 7B in order to perform the light intensity adjustment. In synchronism with this change of the signal 175, the DC voltage component of the developing bias 31 is turned off with the result that the waveform of the developing bias 31 is shifted about 200 V in the positive direction. Such a turn-off operation of the DC voltage component is performed irrespective of the phase of the developing bias. In this case shown in FIGS. 7A to 7C, the DC voltage component of the developing bias 31 is turned off in the phase where the toner has jumped to the photosensitive drum but has not yet returned to the developing roll. However, since the AC voltage component of the developing bias 31 remains applied, the toner is not left on the photosensitive drum but continues a reciprocating motion between the developing roll and the photosensitive drum. Furthermore, an area on the photosensitive drum exposed to light from the semiconductor laser in performing the light intensity development is not developed because the DC voltage component remains off. In this manner, only the DC voltage component is turned off in performing the light intensity adjustment to thereby prevent the toner from being left on the photosensitive drum regardless of a timing of development.

In the second preferred embodiment, the processing of performing the light intensity adjustment at a given position between pages and the processing of turning on and off the DC voltage component at a given timing are substantially the same as those mentioned in the first preferred embodiment. Only one different point is that only the DC voltage component is turned off in performing the light intensity adjustment in the second preferred embodiment rather than the developing bias as a whole is turned off as mentioned in the first preferred embodiment. In the other points such as the point that the given timings are generated by the timers, the second preferred embodiment is the same as the first preferred embodiment; so the explanation thereof will be omitted.

In the first and second preferred embodiments, the on/off switching of the developing bias and the starting of the light intensity adjustment are performed by the sequential processing as shown in FIG. 5. Alternatively, the sequential processing may be replaced by parallel processing. For example, when the times set in the three timers are up, the CPU may be interrupted to thereby eliminate the need of sequentially monitoring the timers.

Although the three timers are used in the first and second preferred embodiments, a single timer may be used to effect similar control. For example, the developing bias on-time is first set in the single timer. If the developing bias on-time is up, the developing bias is turned on, and a time represented by the difference between the light intensity adjustment start time and the developing bias on-time is next set in the same timer. If this time is up, the light intensity adjustment is started, and a time represented by the difference between the developing bias off-time and the light intensity adjustment start time is next set in the same timer. If this time is up, the developing bias is turned off. In this manner, substantially the same control may be effected by using the single timer.

Although the developing bias is turned off at the timing when the potential of the developing bias changes from a positive potential to a negative potential in the first preferred embodiment, any other timings of turning off the developing bias may be selected. It is considered that when the developing bias reaches a positive peak, the toner has already returned to the developing roll. Accordingly, the developing bias may be turned off at the timing just after the developing bias reaches the positive peak or at the timing when the phase of the developing bias becomes 45 degrees after the developing bias reaches the positive peak. To this end, the threshold of the developing bias at which the output level of the comparator 154 changes may be set to a corresponding potential. As previously mentioned, this setting can be realized by changing the combination of the resistances of the resistors 155 to 158.

In the first and second preferred embodiments, the output signal from the paper sensor is used for the timing control of the light intensity adjustment to be performed between the main exposures per page relating to the image information. Alternatively, any means other than the paper sensor may be used to control the timing of the light intensity adjustment.

In the first and second preferred embodiments, a sine wave is used as the AC voltage component of the developing bias. Alternatively, any waveforms other than the sine wave may be used provided that the toner can be reciprocated between the developing unit and the photosensitive drum. For example, a rectangular wave may be used as the AC voltage component.

In addition, the photosensitive drum used as the photosensitive member in the first and second preferred embodiments may be replaced by any other photosensitive members such as a photosensitive belt.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. An image forming apparatus comprising:

a photo sensitive member;

a light source for exposing said photosensitive member according to input image information;

a developing unit located in the vicinity of said photosensitive member with a gap defined therebetween, for making a charged toner jump across the gap to said photosensitive member and developing an electrostatic latent image formed on said photosensitive member;

developing bias applying means for applying to said gap defined between said developing unit and said photosensitive member a developing bias comprising an AC voltage component for reciprocating said charged toner across the gap between said developing unit and said photosensitive member and a DC voltage component for developing said electrostatic latent image;

developing bias application control means for controlling on/off switching of said developing bias to be applied by said developing bias applying means;

phase detecting means for detecting whether a phase of said developing bias is a toner return phase in which said charged toner has returned from said photosensitive member to said developing unit;

off-time phase control means for turning off said developing bias in said toner return phase according to a detection result output from said phase detecting means; and wherein the charged toner has a diameter d, the photosensitive member has a first center axis and a first radius $R_1$ and the developing unit has a second center axis and a second radius $R_2$, wherein a distance between the first center axis and the second center axis is greater than $R_1+R_2+d$.

2. An image forming apparatus comprising:

a photosensitive member;

a laser light source for exposing said photosensitive member according to input image information;

light intensity adjusting means for performing light intensity adjustment by compensating a fluctuation in output level of said laser light source in a time period between exposures per page performed by said laser light source according to said input image information;

a developing unit located in the vicinity of said photosensitive member with a gap defined therebetween, for making a charged toner jump across the gap to said photosensitive member and developing an electrostatic latent image formed on said photosensitive member;

developing bias applying means for applying to said gap defined between said developing unit and said photosensitive member a developing bias comprising an AC voltage component for reciprocating said charged toner across the gap between said developing unit and said photosensitive member and a DC voltage component for developing said electrostatic latent image;

developing bias application control means for controlling on/off switching of said developing bias to be applied by said developing bias applying means so that only said electrostatic latent image formed according to said input image information is developed and another electrostatic latent image formed in association with said light intensity adjustment is not developed;

phase detecting means for detecting whether a phase of said developing bias is a toner return phase in which said charged toner has returned from said photosensitive member to said developing unit; and off-time phase control means for turning off said developing bias in said toner return phase according to a detection result output from said phase detecting means.

3. An image forming apparatus comprising:

a photosensitive member;

a laser light source for exposing said photosensitive member according to input image information;

light intensity adjusting means for performing light intensity adjustment by compensating a fluctuation in output level of said laser light source in a time period between exposures per page performed by said laser light source according to said input image information;

a developing unit located in the vicinity of said photosensitive member with a gap defined therebetween, for making a charged toner jump across the gap to said photosensitive member and developing an electrostatic latent image formed on said photosensitive member;

developing bias applying means capable of independently applying to said gap defined between said developing unit and said photosensitive member an AC voltage for reciprocating across the gap said charged toner between said developing unit and said photosensitive member and a DC voltage for developing said electrostatic latent image; and developing bias application control means for controlling on/off switching of said DC voltage so that only said electrostatic latent image formed according to said input image information is developed and another electrostatic latent image formed in association with said light intensity adjustment is not developed.

4. An image forming apparatus according to claim 1, wherein said off-time phase control means turns off said developing bias at a timing when an output signal from said phase detecting means changes from a high level to a low level for the first time after an output signal from said developing bias application control means becomes a low level.

5. An image forming apparatus according to claim 2, further comprising a paper sensor for detecting a recording paper advancing in a feed path of said recording paper, wherein said light intensity adjustment is performed according to an output signal from said paper sensor.

6. An image forming apparatus according to claim 5, wherein said developing bias application control means comprises a first timer for setting a time internal from a timing when a leading end of said recording paper is detected by said paper sensor to a timing when said developing bias is turned on, a second timer for setting a time internal from said timing of detection of said leading end of said recording paper to a timing when said light intensity adjustment is started, and a third timer for setting a time internal from said timing of detection of said leading end of said recording paper to a timing when said developing bias is turned off.

7. An image forming apparatus according to claim 6, wherein said developing bias application control means further comprises a memory for storing a paper size of said recording paper, wherein said time intervals to be set in said first to third timers are decided according to said paper size read from said memory.

8. An image forming apparatus according to claim 7, wherein said developing bias is turned on just after starting of each exposure per page during said time internal set in said first timer, and said developing bias is turned off just after starting of said light intensity adjustment during said time internal set in said third timer.

9. An image forming apparatus according to claim 7, wherein said developing bias is turned off just before starting of said light intensity adjustment after each exposure per page is ended.

10. An image forming apparatus according to claim 3, wherein said developing bias applying means comprises an AC voltage output controller for switching said AC voltage and a DC voltage output controller for switching said DC voltage.

11. An image forming apparatus according to claim 1, wherein said toner return phase ranges from a first phase just after said AC voltage component of said developing bias reaches a positive peak to a second phase after said first phase by 45 degrees.

12. An image forming apparatus according to claim 2, wherein the charged toner has a diameter d, the photosensitive member has a first center axis and a first radius $R_1$ and the developing unit has a second center axis and a second radius $R_2$, wherein a distance between the first center axis and the second center axis is greater than $R_1+R_2+d$.

13. An image forming apparatus according to claim 3, wherein the charged toner has a diameter d, the photosensitive member has a first center axis and a first radius $R_1$ and the developing unit has a second center axis and a second radius $R_2$, wherein a distance between the first center axis and the second center axis is greater than $R_1+R_2+d$.

* * * * *